US009115323B2

(12) United States Patent
Karzel et al.

(10) Patent No.: US 9,115,323 B2
(45) Date of Patent: Aug. 25, 2015

(54) GASIFICATION REACTOR

(75) Inventors: Paul Christian Karzel, Wiehl (DE); Manfred Heinrich Schmitz-Goeb, Gummersbach (DE)

(73) Assignee: Shell Oil Company, Houston, TX (US)

( * ) Notice: Subject to any disclaimer, the term of this patent is extended or adjusted under 35 U.S.C. 154(b) by 270 days.

(21) Appl. No.: 13/981,922

(22) PCT Filed: Jan. 26, 2012

(86) PCT No.: PCT/EP2012/051184
§ 371 (c)(1),
(2), (4) Date: Sep. 19, 2013

(87) PCT Pub. No.: WO2012/101194
PCT Pub. Date: Aug. 2, 2012

(65) Prior Publication Data

US 2014/0004008 A1 Jan. 2, 2014

(30) Foreign Application Priority Data

Jan. 28, 2011 (EP) ..... 11152587

(51) Int. Cl.
*C10J 3/76* (2006.01)
*C10J 3/48* (2006.01)
*C10J 3/78* (2006.01)

(52) U.S. Cl.
CPC .. *C10J 3/76* (2013.01); *C10J 3/485* (2013.01); *C10J 3/78* (2013.01); *C10J 2200/09* (2013.01)

(58) Field of Classification Search
CPC combination set(s) only.
See application file for complete search history.

(56) References Cited

U.S. PATENT DOCUMENTS 4,466,808 A 8/1984 Koog
2010/0263278 A1* 10/2010 Kowoll et al. ..... 48/67

FOREIGN PATENT DOCUMENTS

| | | |
|---|---|---|
| CN | 2700718 | 5/2005 |
| CN | 101003755 | 7/2007 |
| DE | 102006031816 | 1/2008 |
| DE | 202008009249 | 1/2009 |
| WO | 2005052095 | 6/2005 |
| WO | 2009036985 | 3/2009 |

* cited by examiner

*Primary Examiner* — Kaity Handal

(57) ABSTRACT

A gasification reactor including a gasifier having a tubular gastight wall with a discharge channel or dip tube at its lower end leading into a lower slag collection bath. The gastight wall and the slag collection bath are arranged within a pressure vessel. An annular space between the pressure vessel and the gasifier with the discharge channel is separated in a high pressure top section and a low pressure lower section by a sealing arrangement having a damper. The damper can for instance be a hydraulic lock, or a lower seal at a distance below an upper seal.

12 Claims, 3 Drawing Sheets

GASIFICATION REACTOR

PRIORITY CLAIM

The present application claims priority from PCT/EP2012/051184, filed 26 Jan. 2012, which claims priority from European application 11152587.9, filed 28 Jan. 2011, which is incorporated herein by reference.

BACKGROUND OF THE INVENTION

The present invention relates to a gasification reactor comprising a gasifier in a tubular gastight wall with a lower end opening into an aqueous slag collection bath, wherein the gastight wall is arranged within a pressure vessel.

Gasification reactors can for instance be used for the production of synthesis gas by partial combustion of a carbonaceous feed, such as pulverized coal, oil, biomass, gas or any other type of carbonaceous feed. Some gasification reactor types only have a discharge opening at their lower end for discharging syngas via the aqueous slag collection bath via a discharge, often referred to as dip tube. Due to the pressure build-up in the gasifier freshly produced synthesis gas is forced to flow down through the slag collection bath around the lower edge of the dip tube to be recollected in the annular space between the gasifier wall and the pressure vessel wall. This way the water in the slag collection bath cleans and cools the synthesis gas.

In order to reduce thermal stresses the gasifier wall is typically cooled and can for instance be formed by parallel tubular lines confining channels for a coolant medium such as water. These tubular lines are interconnected to form a gastight wall structure, e.g., in a tube-fin-tube arrangement. These gasifier walls are subjected to loads induced by the high operational pressures within the gasifier. The pressure within the gasifier can be as high as, e.g., 20-80 bar. To reduce pressure induced mechanical loads in the gasifier wall, it is desired to balance the internal gasifier pressure with the pressure in the surrounding annular space between the gasifier and the pressure vessel. This requires that the pressure within the annular space is kept about as high as the pressure within the gasifier. On the other hand, synthesis gas blown from the gasifier into the slag collection bath should be able to bubble up within the annular space between the dip tube and the pressure vessel. This requires that the pressure in the annular space above the slag collection bath should be substantially less than the pressure within the gasifier. This is usually achieved by separating the annular space into an upper section surrounding the gasifier and a lower section above the slag collection bath by means of an annular seal. Such a single seal is simultaneously exposed to a permanent high pressure from the upper section and to a lower pressure from the lower section, which fluctuates with a high frequency when synthesis gas bubbles up from the slag collection bath. The accumulated loading pattern can lead to early failure of the seal.

It is an object of the invention to provide a robust and reliable separation of the upper and lower sections of the annular space between the gasifier wall and the surrounding pressure vessel.

SUMMARY OF THE INVENTION

The object of the invention is achieved with a gasification reactor comprising a gasifier having a tubular gastight wall with a discharge channel at its lower end leading into a lower slag collection bath, wherein the gastight wall and the slag collection bath are arranged within a pressure vessel, and wherein an annular space between the pressure vessel and the gasifier with the discharge channel is separated in a high pressure top section and a low pressure lower section by a sealing arrangement comprising a damper. This way the sealing arrangement is at least partly relieved from mechanical stresses induced by the fluctuating pressure loads in the lower section.

The sealing arrangement can for instance comprise an upper seal, wherein the damper is formed by a lower seal at an axial distance below the upper seal. This way, the upper pressure seal is only subjected to the high static pressure in the upper section around the gasifier, while the lower seal damps the fluctuating lower pressures induced by the pulsating synthesis gas flow in the lower section without being subjected to the high static pressure in the upper section. Deformations of the lower seal induced by pressure fluctuations will not cause a substantial change of the volume of the space between the two seals, so the pressure fluctuations within the intermediate space will typically be negligible, or at least be substantially less than in the section below the lower seal.

One or more discharge channels for the discharge of synthesis gas will typically be connected to openings in the pressure vessel wall at a position below the lower seal to lead the synthesis gas to downstream equipment, such as heat exchangers for cooling the gas or equipment for gas treatment.

The upper seal can be designed to withstand high static pressures and can for instance be an annular plate, e.g., a metal plate such as a steel plate, having its outer circumference welded to the inner surface of the pressure vessel wall and its inner circumference welded to the wall of the gasifier, in particular to the synthesis gas discharge of the gasifier, or the dip tube.

Differences in expansion between the pressure vessel and the gasifier with the dip tube result in additional mechanical stresses within the upper and lower seal. In order to reduce these stresses, the annular plate of the upper and/or lower seal can for instance have a stepped configuration in cross section. The inner half of the cross section can for instance be offset in downward or upward direction relative to the outer half, or the cross section can show a midsection which is offset downwardly or upwardly relative to the edges.

The lower seal can be designed to cope with pressure differences fluctuating with a high frequency. Like the upper seal, the lower seal can for instance be an annular plate, e.g., a metal plate such as a steel plate, having its outer circumference welded to the inner surface of the pressure vessel wall and its inner circumference welded to the wall of the gasifier, in particular to the synthesis gas discharge of the gasifier. In view of the different load pattern the lower seal may be more flexible than the upper seal, e.g., by having a thinner wall thickness.

Optionally, the intermediate space between the seals can be operatively connected to a supply of purging gas. This way, the pressure within the intermediate space can be controlled to create an effective buffer between the high pressure environment in the pressure vessels upper section and the fluctuating pressure environment in the pressure vessels lower section. The purging gas can for instance be nitrogen.

Additionally, or alternatively, the space between the two seals is provided with one or more pressure control units, such as one or more overpressure valves.

In a further embodiment, the sealing arrangement can comprise at least two annular members extending from opposite sides of the annular space having interlocking free ends spaced to confine a hydraulic lock forming the damper. For instance, the pressure vessel wall carries one of the annular members, the annular member having a free inner circumference carrying a vertically extending first cylinder wall, while the other annular member is carried at the side of the gasifier wall, having a free outer circumference carrying a vertically extending second cylinder wall coaxially arranged within the first cylinder wall, wherein the space between the two cylinder walls is in hydraulic communication with the upper and lower sections of the annular space and is at least partly filled with a liquid, typically water, to form the hydraulic lock.

This way, the sealing and damping function can be integrated in a single seal. Alternatively, the hydraulic lock can be part of a lower seal at a distance below an upper seal, as described above.

The hydraulic lock may for instance comprise one or more supplies for the supply of water or any other suitable type of hydraulic liquid. The water supply can for instance be continuous. This way, the lock can be flushed, regularly or continuously. Corrosive solutions in the water are diluted and possible viscosity changes caused by concentration of dispersed particles are prevented.

Optionally, the hydraulic lock can comprise an overflow that guides overflowing water along at least a part of the gasifier wall, e.g., along the discharge channel or dip tube. The overflowing water cools the gasifier wall to reduce thermal loads and contributes to the robustness and reliability of the reactor. Additionally, or alternatively, one or more water supplies for supplying water to the hydraulic lock can be arranged to guide water along at least a part of the gasifier wall, e.g., along the discharge channel or dip tube.

Drain openings can be provided at the bottom of the hydraulic lock to avoid deposits, e.g., of fly ash particles.

If the discharge channel, or dip tube, is suspended from supports at the inner surface of the pressure vessel wall within the space between the two seals, the supports are effectively shielded against fly ash and thermal loads of the hot synthesis gas.

The sealing arrangement can for instance be positioned at the level of the discharge channel, or dip tube. This way, the gasifier wall above the discharge channel is surrounded by the high pressure environment of the pressure vessels upper section.

Optionally, the gasification reactor can be provided with one or more connections for the supply of purging gas to the space above the damper, e.g., above the hydraulic lock to control the water level, or between the upper and lower seal to control the pressure in the intermediate space.

BRIEF DESCRIPTION OF THE DRAWINGS

Exemplary embodiments of the invention will now be described by reference to the accompanying drawing, in which.

DESCRIPTION OF THE PREFERRED EMBODIMENT

Figure 1:
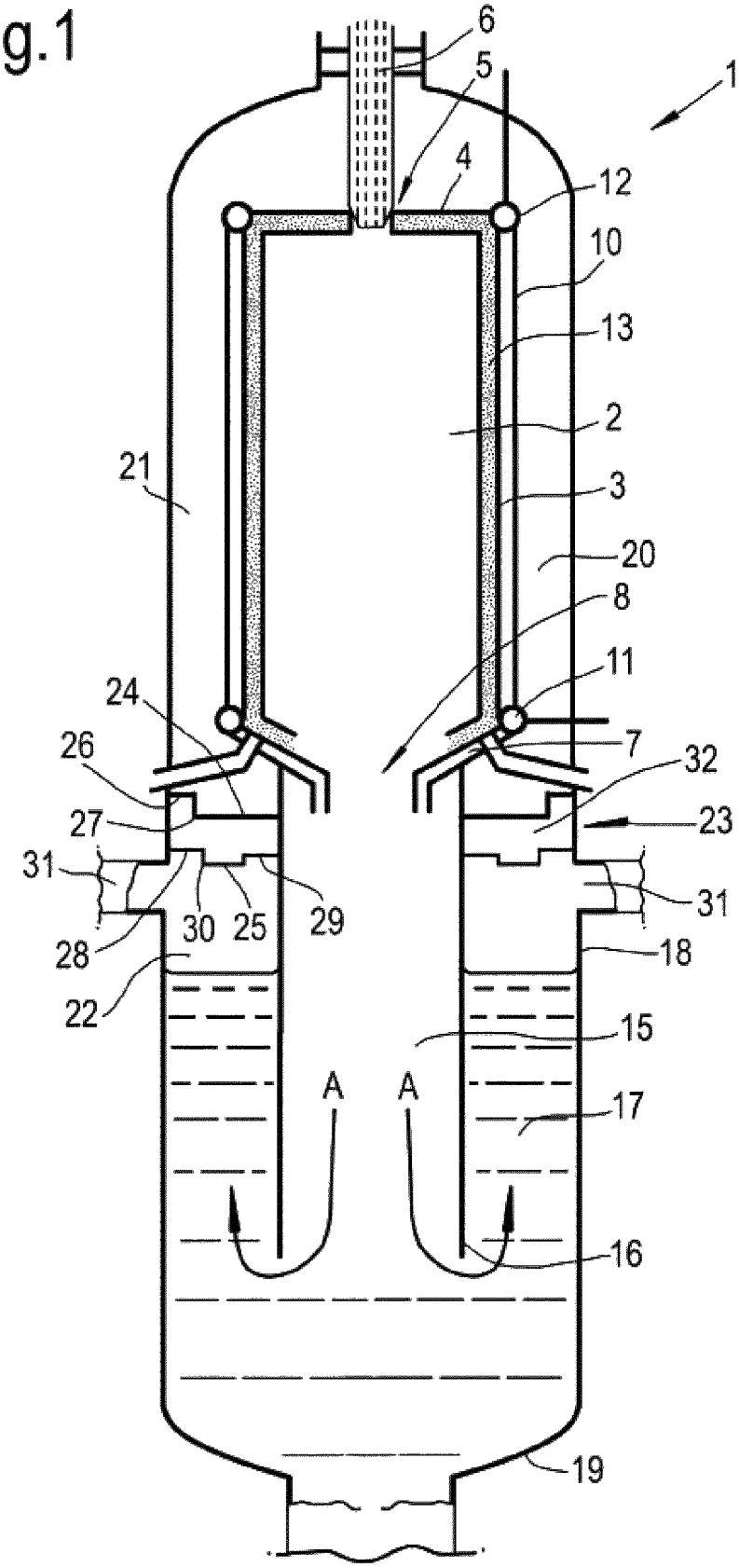
FIG. 1: shows schematically an embodiment of a gasification reactor according to the invention.

FIG. 1 shows a gasification reactor 1 comprising a gasifier 2 with a cylindrical gasifier wall 3, a closed top end 4 having a central passage opening 5 for passage of a burner 6, and a tapering lower end 7 narrowing down to a gas discharge opening 8. Alternatively, or additionally, the gasification reactor can have one or more burners entering the gasifier from a lateral position. The gasifier wall 3 is built of parallel vertical coolant lines 10 interconnected to form a gastight structure. At the lower end of the coolant lines 10 a coolant medium is supplied via a circular distributor line 11. The coolant medium is discharged via a circular header line 12 on top of the coolant lines 10. In this particular embodiment, the inner surface of the gasifier wall 3 is provided with a refractory liner 13.

A cylindrical discharge channel or dip tube 15 is arranged in line with the discharge opening 8. The dip tube 15 has a lower end 16 extending into a coolant reservoir 17, such as a water bath. The gasifier 2, the dip tube 15 and the coolant reservoir 17 are coaxially arranged within a cylindrical pressure vessel 18 with a bottom 19 at a distance from the lower end 16 of the dip tube 15.

In the gasifier 2 synthesis gas is produced by partial combustion of a carbonaceous feed fed into the gasifier 2 via the burner 6. The gas flow path is indicated in FIG. 1 by arrows A. The pressurized synthesis gas flows into the water of the coolant reservoir 17 around the lower end 16 of the dip tube 15 and flows back upwardly at the exterior side of the dip tube 15.

The gasifier 2 with the discharge channel 15 is substantially coaxial with the pressure vessel 18. This leaves an annular space 20 between the inner surface of the pressure vessel 18 and the gasifier 2 with the dip tube 15. The annular space 20 is divided between an upper section 21 and a lower section 22 by a sealing arrangement 23. The sealing arrangement 23 comprises an upper seal 24 and a lower seal 25 at a distance below the upper seal 24.

The upper seal 24 is an annular steel plate having its outer circumference 26 welded to the inner surface of the pressure vessel wall and its inner circumference 27 welded to the wall of the dip tube 15. The outer circumference 26 is offset from the rest of the annular plate over a certain upward distance.

Similarly, the lower seal 25 is an annular steel plate having its outer circumference 28 welded to the inner surface of the pressure vessel wall and its inner circumference 29 welded to the wall of the dip tube 15 at a distance below the upper seal 24. An annular middle section 30 is offset downwardly from the inner and outer circumferences 28, 29. This gives the lower seal 25 the required flexibility for absorbing pressure fluctuations.

The upper section 21 encloses the gasifier 2. Mechanical stress loads in the gasifier wall 3 are reduced by equalizing the pressure in the upper section 21 with the high pressure within the gasifier 2. The pressure in the lower section 22 should be sufficiently low, e.g., 0-1 bar below the pressure in the upper section 21. As a result, synthesis gas, forced to flow from the gasifier through the dip tube 15, bubbles up into the low pressure lower section 22. Discharge lines 31 discharge the produced synthesis gas to downstream equipment, such as coolers (not shown).

The upper seal 24 is subjected to the high pressure in the upper section 21. The lower seal 25 is not subjected to the pressure in the upper section 21 but only to the pressure within the lower section 22, which is generally lower during normal operation. The flow of synthesis gas through the reservoir 17 bubbles upwardly into the lower section 22 which results in a fluctuating pressure within the lower section 22. The lower seal 25 damps the pressure fluctuations and effectively prevents that the upper seal 24 is subjected to these pulsations.

Between the upper seal 24 and the lower seal 25 an intermediate space 32 is present with an internal pressure kept at a desired level by a supply of purging gas (not shown). The pressure will typically be between the high upper section pressure and the average lower section pressure.

Figure 2:
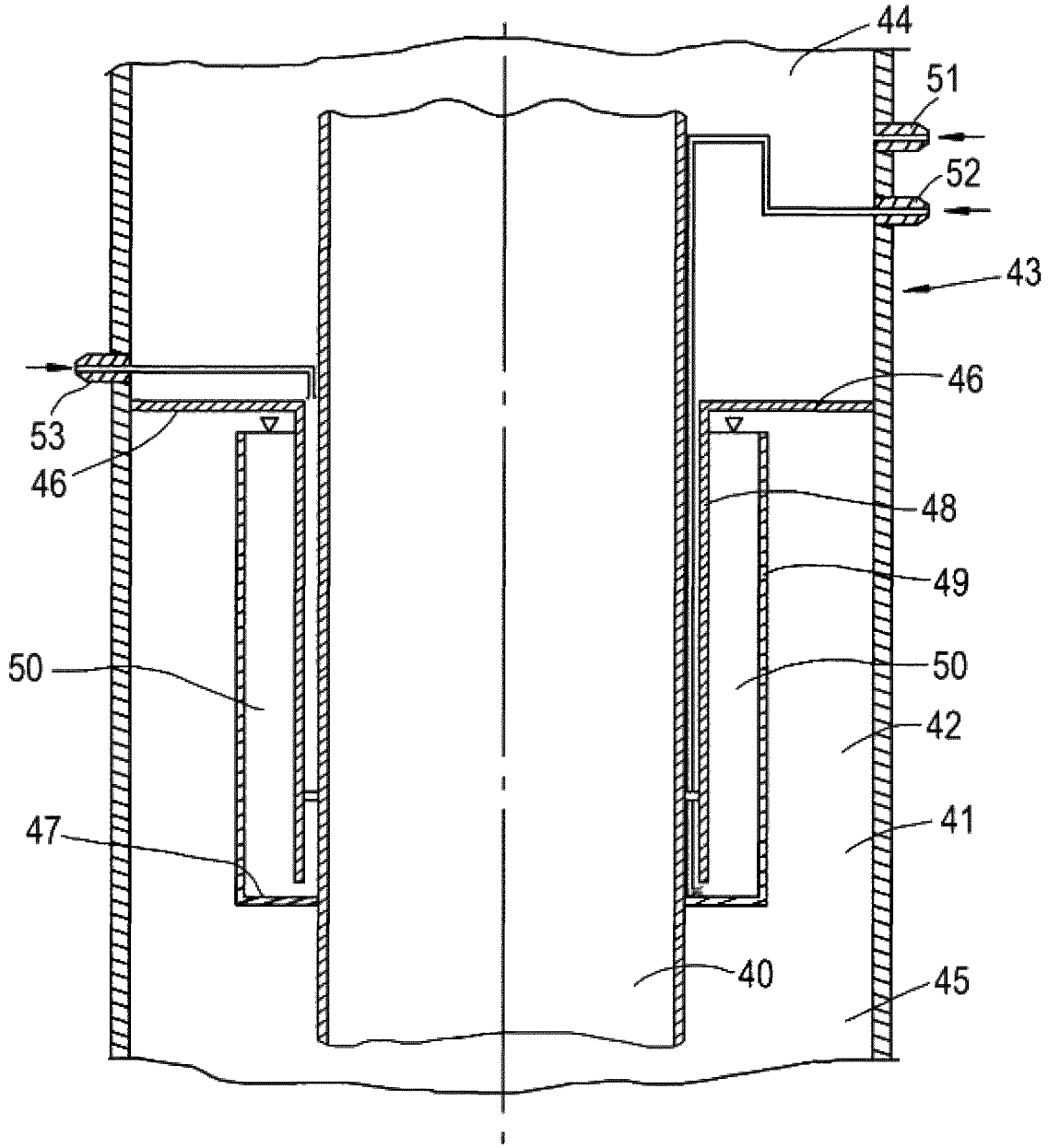
FIG. 2: shows schematically a second embodiment of a gasification reactor according to the invention.

FIG. 2 shows schematically in cross section a detail of an alternative embodiment of a gasification reactor according to the present invention. In the drawing, a dip tube 40 extends coaxially within a vertically arranged pressure vessel 41. An annular space 42 between the pressure vessel 41 and the dip tube 40 is divided by a sealing arrangement 43 into an upper section 44 and a lower section 45.

The sealing arrangement 43 comprises two annular members 46, 47 extending from opposite sides of the annular space 42. The pressure vessel wall carries a first annular member 46, which has a free inner circumference carrying a downwardly extending first cylinder wall 48. The second annular member 47 is carried by the dip tube 40 at the side of the gasifier wall. The second annular member 47 has a free outer circumference carrying an upwardly extending second cylinder wall 49 coaxially arranged within the first cylinder wall 48. This way, the cylinder walls 48, 49 form interlocking free ends of the annular members 46, 47 spaced to confine a hydraulic lock 50. The hydraulic lock 50 forms a damper damping the pressure fluctuations in the lower section 45 induced by synthesis gas bubbling up from the lower end of the dip tube 40. The upper section 44 is effectively sealed from the lower section 45 without the need to absorb mechanical stresses induced by differences in thermal expansion between the dip tube 40 and the pressure vessel wall. Moreover, fly ash will be trapped in the water of the hydraulic lock, which keeps the upper section 44 substantially free of fly ash.

The upper section 44 is provided with a connection 51 for a supply of purge gas, which is used to control the water level in the hydraulic lock 50. The flow of purge gas can be kept at a constant level in order to eliminate the need for a complicated control system.

Water flows from one or more water supplies 52, 53 to the hydraulic lock 50. The water is guided along the outer surface of the dip tube 40 in order to cool it.

Figure 3:
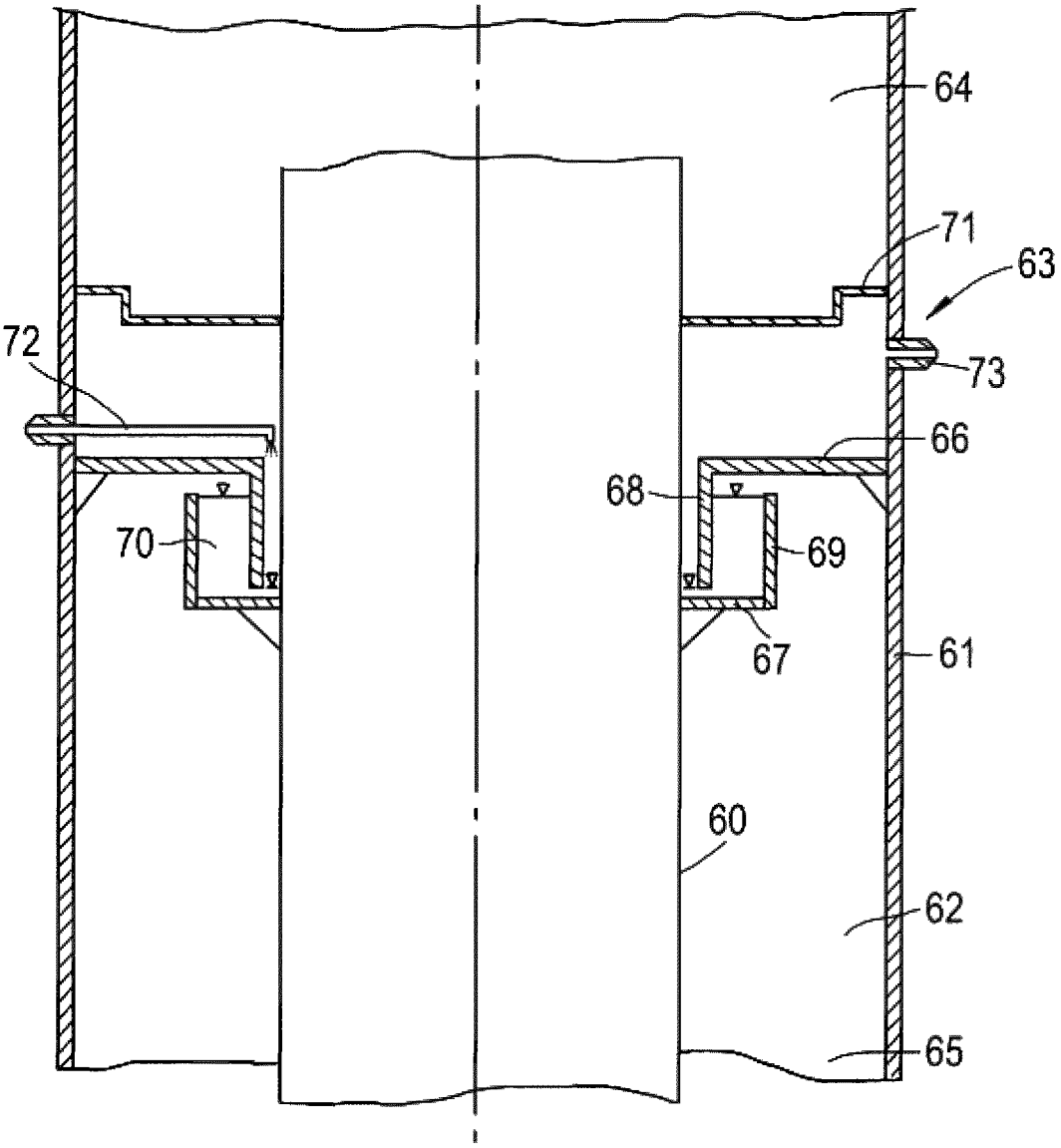
FIG. 3: shows schematically a third embodiment of a gasification reactor according to the invention.

FIG. 3 shows schematically a dip tube 60 coaxially arranged within a pressure vessel 61 of an embodiment of a gasification reactor. As with the embodiment in FIG. 2, an annular space 62 between the pressure vessel 61 and the dip tube 60 is divided by a sealing arrangement 63 into an upper section 64 and a lower section 65. The sealing arrangement 63 comprises two annular members 66, 67 extending from opposite sides of the annular space 62. The pressure vessel wall carries a first annular member 66, which carries a downwardly extending first cylinder wall 68 at its free inner circumference. The second annular member 67 is supported by the dip tube 60 at the side of the gasifier wall. The second annular member 67 carries an upwardly extending second cylinder wall 69 coaxially arranged within the first cylinder wall 68. The parallel cylinder walls 68, 69 confine a hydraulic lock 70. Thus, the lower seal portion of sealing arrangement 63 comprises members 66, 67, the downwardly extending first cylinder wall 68, the upwardly extending second cylinder wall 69 and the hydraulic lock 70.

In this embodiment, the sealing arrangement 63 also comprises an upper seal 71 shielding the hydraulic lock 70 from the high pressure within the upper section 64. The upper seal 71 is an annular steel ring fully bridging the annular space 62 and welded in a gastight manner to the inner surface of the pressure vessel 61 and the outer surface of the dip tube 60.

The hydraulic lock 70 forms a damper damping the pressure fluctuations in the lower section 65 induced by synthesis gas bubbling up from the lower end of the dip tube 60. The hydraulic lock 70 is dimensioned in such a way that the hydrostatic height is equal to the design pressure difference plus the fluctuating component of the pressure difference. The hydraulic lock 70 will serve as an overpressure relief valve, so the pressure difference over the sealing arrangement 63 is limited to the hydrostatic height of the water column within the hydraulic lock 70.

Water flows from one or more water supplies 72 to the hydraulic lock 70. The water is guided along the outer surface of the dip tube 60 in order to cool it.

One or more purge gas feed lines 73 feed a purging gas, e.g., nitrogen, to the space between the first cylinder and the dip tube 60. The purging gas serves to keep the water in the hydraulic lock at a desired level.

What is claimed is:

1. A gasification reactor comprising a gasifier having a tubular gastight wall with a discharge channel at its lower end leading into a lower slag collection bath, wherein the gastight wall and the slag collection bath are arranged within a pressure vessel, and wherein an annular space between the pressure vessel and the gasifier with the discharge channel is separated in a high pressure top section and a low pressure lower section by a sealing arrangement comprising a damper, wherein the sealing arrangement comprises an upper seal and the damper is formed by a lower seal at an axial distance below the upper seal, wherein the sealing arrangement comprises at least two annular members extending from opposite sides of the annular space having interlocking free ends spaced to confine a hydraulic lock forming the damper, wherein the pressure vessel wall carries a first one of the annular members, the first annular member having a free inner circumference carrying a vertically extending first cylinder wall, while the second annular member is carried at the side of the gasifier wall, the second annular member having a free outer circumference carrying a vertically extending second cylinder wall coaxially arranged within the first cylinder wall, wherein the space between the two cylinder walls is in hydraulic communication with the upper and lower sections of the annular space and is at least partly filled with a liquid to form the hydraulic lock.

2. A gasification reactor according to claim 1 wherein the intermediate space between the two seals is provided with one or more pressure control units.

3. A gasification reactor according to claim 2 wherein the pressure control units include one or more overpressure valves.

4. A gasification reactor according to claim 1 wherein at least one of the seals is a metal annular plate welded in a gastight manner along its inner circumference to the gasifier wall with the discharge and with its outer circumference to the pressure vessel wall.

5. A gasification reactor according to claim 1 wherein the discharge channel is suspended from supports at the inner surface of the pressure vessel wall within the space between the two seals.

6. A gasification reactor according to claim 1, wherein the lower seal is formed by the two annular members confining the hydraulic lock positioned at a distance below the upper seal.

7. A gasification reactor according to claim 6 wherein the hydraulic lock comprises one or more water supplies.

8. A gasification reactor according to claim 7 wherein at least one of the water supplies is arranged to guide water along at least a part of the gasifier wall with the discharge channel.

9. A gasification reactor according to claim 6 wherein the hydraulic lock comprises an overflow guiding overflowing water along a part of the gasifier wall with the discharge channel.

10. A gasification reactor according to claim 6 wherein the hydraulic lock comprises one or more drain openings.

11. A gasification reactor according to claim 1, wherein the sealing arrangement is positioned at the level of the discharge channel.

12. A gasification reactor according to claim 1, wherein the reactor is provided with one or more connections for the supply of purging gas to the space above the damper.

* * * * *